US005268347A

United States Patent [19]

Okumura et al.

[11] Patent Number: 5,268,347

[45] Date of Patent: Dec. 7, 1993

[54] IMAGE-RECEIVING SHEET FOR THERMAL TRANSFER PRINTING WITH AN INTERMEDIATE LAYER CONTAINING FINE PARTICLES OF THERMOSETTING RESIN AND FINE PARTICLES OF POLYOLEFIN RESIN

[75] Inventors: Yoshitaka Okumura, Kyoto; Kazuo Watanabe, Itami; Hiromasa Kondo, Ikoma; Noritaka Egashira, Ichikawa; Naoto Satake, Tokyo, all of Japan

[73] Assignees: Kanzaki Paper Manufacturing Co., Ltd.; Dai Nippon Insatsu Kabushiki Kaisha, both of Tokyo, Japan

[21] Appl. No.: 600,997

[22] Filed: Oct. 18, 1990

Related U.S. Application Data

[63] Continuation-in-part of Ser. No. 438,004, Nov. 20, 1989, abandoned.

[30] Foreign Application Priority Data

Nov. 21, 1988 [JP] Japan ..... 63-294377

[51] Int. Cl.[5] ..... B41M 5/035; B41M 5/38

[52] U.S. Cl. ..... 503/227; 428/195; 428/207; 428/327; 428/913; 428/914

[58] Field of Search ..... 8/471; 428/195, 207, 428/913, 914, 327; 503/227

[56] References Cited

U.S. PATENT DOCUMENTS 4,837,200 6/1989 Kondo et al. ..... 503/227

*Primary Examiner*—B. Hamilton Hess

*Attorney, Agent, or Firm*—Wenderoth, Lind & Ponack

[57] ABSTRACT

An image-receiving sheet for thermal transfer printing comprising a substrate, an intermediate layer and an image-receiving layer, said intermediate layer and said image-receiving layer being disposed in this order on said substrate, characterized in that said intermediate layer comprises a layer containing (a) fine particles of one or more kinds of resins selected from the group consisting of thermosetting resins and other resins having a softening point of higher than 150° C. and (b) fine particles of a polyolefin resin as the main constituents and the amount of said fine particles (a) contained in the intermediate layer is in the range of from 5 to 90% by weight.

The image-receiving sheet excells in the whiteness and opacity and exhibits an excellent recording sensitivity. The image-receiving sheet provides high quality images accompanied with no missing dot when used in a thermal transfer printing system wherein a thermally sublimable dye is utilized.

3 Claims, No Drawings

IMAGE-RECEIVING SHEET FOR THERMAL TRANSFER PRINTING WITH AN INTERMEDIATE LAYER CONTAINING FINE PARTICLES OF THERMOSETTING RESIN AND FINE PARTICLES OF POLYOLEFIN RESIN

This application is a continuation-in-part of now abandoned application, Ser. No. 07/438,004 filed on Nov. 20, 1989, now abandoned.

BACKGROUND OF THE INVENTION

1. Field of the Invention

The present invention relates to an improved image-receiving sheet for thermal transfer printing in which a thermally sublimable dye is used. More particularly, the present invention relates to an improved image-receiving sheet for thermal transfer printing which has an improved intermediate layer containing fine particles of thermosetting resin and fine particles of polyolefin resin and which exhibits an improved recording sensitivity and provides excellent printed images with no missing dots.

2. Description of the Prior Art

Thermal printing systems in which printed images are obtained upon reception of input signals are made up of a relatively simple apparatus and are inexpensive and low in noise. In view of this, they have increasing utility in various fields such as facsimiles, terminal printers for electronic computers, printers for measuring instruments, video printers, and the like.

As the recording medium to be used in these thermal printing systems, there has been generally used a so-called spontaneous developing heat sensitive paper having a recording layer capable of causing a physical or chemical change upon application of heat to provide color development. However, the spontaneous developing heat sensitive paper of the color developing type has disadvantages in that it is liable to undesirably cause color development during the fabrication process or during storage; and the images printed on the paper are poor in storage stability and they are apt to fade on contact with organic solvents or chemicals.

In order to improve the above situation, there has been proposed a printing system wherein a recording medium in which a coloring material such as a dye or colorant is utilized is used instead of the foregoing spontaneous developing heat sensitive paper, for example, as disclosed in Japanese Unexamined Patent Publication Sho. 51(1976)-15446. In the printing system disclosed in this publication, a sheet comprising a substrate such as a paper or polymer film and a colorant layer containing the coloring material (which is in the solid or semi-solid state at ordinally temperature) being formed on the substrate is firstly provided, and this sheet and a recording sheet are superposed so as to make the colorant layer contacted with the recording sheet and heated from the non-faced side of the former sheet by a heating means such as a thermal head to transfer the coloring material in the colorant layer on the recording sheet upon the electric signals provided by the heating means, whereby images corresponding to image information are recorded on the recording sheet.

In the above printing system, the coloring material in the colorant layer is caused to melt, evaporate or sublimate by application of heat and transferred on the recording sheet, thereby forming a record image by adhesion, adsorption or reception of the coloring material on the recording sheet. In view of this, this printing system has been evaluated as being advantageous from the viewpoint that there can be used an ordinary paper (wood free paper) as the recording sheet. Further, as for this printing system, when a sublimable dye is used as the coloring material, there can be obtained a printed image excelling in tone reproduction. In order to develop this advantage in the full-color printing, various studies have been made.

However, there are disadvantages for the foregoing printing system wherein an ordinary paper (wood free paper) is used as the recording sheet in that sufficient dye-reception hardly occurs causing such printed images which are poor in color density (optical density) and whose image is markedly discolored as time lapses.

To avoid this, there has been proposed the use of an image-receiving sheet having an image-receiving layer containing a thermosetting resin as the main constituent which is formed on a substrate as disclosed in Japanese Unexamined Patent Publication Sho. 57(1982)-107885 or U.S. Pat. No. 3,601,484.

The use of this image-receiving sheet is effective in somewhat improving the recording sensitivity and storage-ability. However, there still remains a problem that when an ordinary paper (wood free paper) is used as the substrate, it is difficult to provide a desirable image-receiving layer containing a thermosetting resin as the main constituent of uniform thickness with the paper and thus, the resulting image-receiving sheet unavoidably becomes such that it is poor in recording sensitivity and provides undesirable images inferior in quality.

In order to eliminate the above problem, there has been proposed another image-receiving sheet having an intermediate layer comprising a thermosetting resin which is disposed between a substrate and an image-receiving layer as disclosed in Japanese Unexamined Patent Publication Sho. 60(1985)-236794 or Sho. 61(1986)-144394.

This image-receiving sheet is so designed that its image-receiving layer can be effectively contacted with the dye layer of the dye transfer sheet to prevent occurrence of negative phenomena such as air-gap upon printing, and it exhibits an improved recording sensitivity and provides improved record images.

In addition, there has been proposed a further image-receiving sheet having an intermediate layer containing fine particles of a specific polyolefin resin which is disposed between a substrate and an image-receiving layer by, among others, four of the coinventors of the present invention as disclosed in U.S. Pat. No. 4,837,200. The use of this image-receiving sheet is effective especially in obtaining desirable recorded images free of any missing transfer portion.

SUMMARY OF THE INVENTION

The present inventors have made various studies on the foregoing image-receiving sheets having an intermediate layer in order to make further improvements therefor.

As a result, it has been found that any of said image-receiving sheets is still accompanied with a disadvantage in that it is necessary to use a sufficiently bright sheet as the substrate, and furthermore, it is extremely difficult to obtain a sufficiently bright image-receiving sheet which is practically acceptable as a recording sheet, since the intermediate layer is insufficient in the covering power particularly when it is formed by the use of fine particles of a single resin. Because of this, there is a limit for the kind of substrate to be used in any of the foregoing cases.

The present inventors have tried to incorporate into the intermediate layer an inorganic pigment such as calcium carbonate, talc, kaolin, titanium oxide, aluminum hydroxide, zinc oxide, etc., or an organic pigment, wherein an ordinary paper was used as the substrate, in order to eliminate the foregoing disadvantage. As a result, it has been found that the resulting image-receiving sheet becomes accompanied with a further disadvantage of causing reduction in the optical density and also in the quality of images as printed, and this situation becomes significant as the amount of such pigment to be incorporated in the intermediate layer increases.

Based upon the above findings, the present inventors have made further studies in order to provide a desirably improved image-receiving sheet comprising a substrate, an intermediate layer and an image-receiving layer for thermal transfer printing for use in the printing system wherein a coloring material, particularly a sublimable dye is thermally transferred.

As a result, it has been found that when the intermediate layer is formed by using fine particles of a specific thermosetting resin and fine particles of a polyolefinic resin in combination, there can be obtained a desirable image-receiving sheet having an improved opacity for the intermediate layer. And as a result of evaluating the image-receiving sheet thus obtained with various items required for an image-receiving sheet to be practically applicable, it has been found that it is extremely high in recording sensitivity and provides high quality record images excelling in resolution, clearness and optical density and which are not accompanied with any missing dots. It has been also found that the foregoing image-receiving sheet is satisfactory in brightness and opacity even in the case where an ordinary paper (wood free paper) is used as the substrate and it can be mass-produced with a reduced cost.

The present invention has been accomplished based on the above findings.

An object of the present invention is to provide an improved image-receiving sheet for thermal transfer printing which is free of the foregoing problems which are found in the known image-receiving sheet and which enables one to form beautiful record images of high optical density.

Another object of the present invention is to provide an improved image-receiving sheet which is satisfactory in brightness and opacity even upon using an ordinary paper (wood free paper) as the substrate.

A further object of the present invention is to provide an improved image-receiving sheet which exhibits an excellent recording sensitivity and provides high quality record images excelling in resolution and clearness which are not accompanied with any missing dots.

DETAILED DESCRIPTION OF THE INVENTION

The present invention attains the above objects and provides an improved image-receiving sheet for thermal transfer printing for use in the printing system wherein a sublimable dye is thermally transferred.

The image-receiving sheet of the present invention comprises a substrate usable for an image-receiving sheet, an intermediate layer and an image-receiving layer, said intermediate layer and said image-receiving layer being disposed in this order on said substrate, wherein said intermediate layer comprises a layer containing fine particles of a polyolefin resin as an essential constituent and as another essential constituent, fine particles of one or more kinds of resins selected from the group consisting of thermosetting resins, other resins having a softening point of higher than 120° C. or preferably, higher than 150° C. and mixtures of these two kinds of resins.

Thus, the image-receiving sheet according to the present invention is characterized by having a specific intermediate layer containing a combination of (a) fine particles of a polyolefin resin (hereinafter referred to as "polyolefin resin fine particle") and (b) fine particles of a thermosetting resin (hereinafter referred to as "thermosetting resin fine particle"); a combination of said polyolefin resin fine particle (a) and (c) fine particles of a thermoplastic resin having a softening point of higher than 120° C. or preferably, higher than 150° C. (hereinafter referred to as "thermoplastic fine particle"); or a combination of said polyolefin resin fine particle (a) and a mixture composed of said thermosetting resin fine particle (b) and said thermoplastic fine particle (c), said mixture having a softening point of higher than 120° C. or preferably, higher than 150° C.

In other words, the intermediate layer of the image-receiving sheet according to the present invention is comprised of polyolefin resin fine particle and other resin fine particle which is not softened at a temperature of lower than 120° C.

As for the polyolefin resin which is of a low softening point and flexible and which is capable of contributing to improving the recording sensitivity and the quality of an image printed when used in the image-receiving sheet, there can be mentioned, for example, polyethylene, polypropylene, polybutene-1, polyisobutylene, polypentene-1, polyhexene-1, poly-3-methylbutene-1, poly-4-methylpentene-1, poly-5-methylhexene-1, etc., and copolymers of two or more of these polymers.

These polyolefin resins are commercially available in the form of fine particles.

These polyolefin resin fine particles are not soluble in organic solvents and because of this, they can be desirably used in the formation of an intermediate layer not only in the case where an image-receiving layer is formed in the organic solvent system but also in the aqueous system.

However, the softening point of any of the foregoing polyolefin resin fine particles is in the range of 40° to 150° C. Therefore, they are problematic upon forming the intermediate layer with the use of any of them since they are softened and finally melted with the heat applied in the process of preparing an image-receiving sheet. Thus, the resulting intermediate layer unavoidably becomes such that is inferior in covering power.

In view of the above, in the present invention, the fine particles of one or more resins which are not softened at a temperature of lower than 120° C. and which are therefore not melted by the heat applied in the process of preparing the image-receiving sheet are purposely used. When said fine particles are used together with the polyolefin resin fine particle for the formation of the intermediate layer, the resulting intermediate layer becomes provided with a desirable brightness and a desirable opacity. Further in addition, the resulting intermediate layer has such a layer structure that contains a plurality of minute cavities. For these reasons, the resulting image-receiving sheet having such a intermediate layer has a desirable heat-resistance and provides a significant effect of enhancing the printing density, whereby obtaining extremely high quality printed images, since it is free of such a disadvantage that loss of energy occurs due to endothermal phenomenon caused by the melting of the constituent fine particles upon printing, which is often found on the known image-receiving sheet.

As the usable resin in fine particle form which is not softened at a temperature of lower than 120° C. and which is used together with the polyolefin resin fine particle for the formation of the intermediate layer in the present invention, there can be mentioned various cross-linked resins (namely, various thermoplastics) and various thermosetting resins. These resins can be used singly or in combination of two or more of them. Specific examples of the cross linked resin fine particles are, for example, fine particles of cross linked styrenic resins, fine particles of cross linked styrene-acrylic resins, etc. Specific examples of the thermosetting resin fine particle are phenol resin fine particle, urea resin fine particle, melamine resin fine particle, aryl resin fine particle, polymide resin fine particle, benzoguanamine resin particle, etc.

The term "softening point" in the present invention denotes the temperature when a high molecular material converts from the original solid state into a state of low elastic modules, i.e. a so-called gum state, as the temperature heightens and then it is softened and melted as the temperature further heightens. The polyolefin resin fine particle (that is, the fine particles of the polyolefin resin) to be used for the formation of the intermediate layer in the present invention is desired to be of a mean particle size in the range of from 1 to 20 μm. Likewise, the fine particles of the resin which is not softened of a temperature of lower than 120° C. are desired to be of a mean particle size corresponding to one fifth or less of the mean particle size of the polyolefin resin fine particle to be used.

In the present invention, the polyolefin resin fine particle and the fine particles of the resin which is not softened at a temperature of lower than 120° C. are mixed at an appropriate mixing ratio in the range where the characteristics of the intermediate layer are not hindered.

However, in general, the amount of the fine particles of the resin which is not softened at a temperature of lower than 120° C. to be mixed with the polyolefin resin fine particle is desired to be preferably in the range of from 5 to 90% by weight, more preferably in the range of from 10 to 60% by weight, respectively, based upon the total amount of the high softening point resin fine particle and the polyolefin resin fine particle. When it is less than 5% by weight, the resulting intermediate layer has insufficient brightness and opacity. On the other hand, when it exceeds 90% by weight, negative reduction will be caused for the optical density and the quality of an image as printed.

The intermediate layer according to the present invention may be formed as follows. That is, firstly, an aqueous emulsion containing the foregoing the fine particles of the resin which is not softened at a temperature of lower than 120° C. and the foregoing polyolefin resin fine particle is prepared. Then, a synthetic polymer adhesive such as polyacrylic acid ester, styrene-butadiene copolymer or polyvinyl acetate and/or a natural adhesive such as starch or casein are dispersed into the foregoing aqueous emulsion to obtain a coating composition. The coating composition thus obtained is applied onto the surface of a substrate in a predetermined amount by known coating means such as wire-bar coater, air-knife coater, blade coater, gravure-roll coater, curtain coater, etc., to thereby form a liquid coat to be the intermediate layer, followed by air-drying.

Thus, there can be formed the intermediate layer as desired.

As for the amount of the foregoing coating composition to be applied onto the surface of a substrate for forming the intermediate layer, it is desired to be preferably 1 g/m$^2$ or more, more preferably in the range of from 3 to 30 g/m$^2$ on a dry basis.

In a preferred embodiment, the intermediate layer thus formed is graduated with heat or pressure using a proper graduation means such as super calender after or prior to forming the image-receiving layer thereon. In this case, the recording sensitivity of the resulting image-receiving sheet is markedly improved to provide a significantly high quality printed image.

For the image-receiving layer to be formed on the intermediate layer in the present invention, there is not any particular restriction. However, it is desired to be comprised of a thermosetting resin layer capable of exhibiting an effective dye-receptivity for a sublimable dye.

As the thermosetting resin to constitute the image-receiving layer, there can be mentioned, for example, polymers of vinyl monomer such as styrene, vinyltoluene, acrylic ester, methacrylic ester, acrylonitrile, vinyl chloride, vinyl acetate, etc.; copolymers of these monomers; condensed polymers such as polyester, polyamide, polycarbonate, polysulfone, epoxy resin, polyurethane, etc.; and cellose resins.

These thermosetting resins may be used alone or in combination of two or more of them.

In case where necessary, the image-receiving layer in the present invention may contain one or more of other resins selected from the group consisting of methyl cellulose, ethyl cellulose, hydroxypropyl cellulose, starch, polyvinyl alcohol, polyamide resin, phenol resin, melamine resin, urea resin, urethane resin, epoxy resin, silicone resin, etc. in an amount in the range where the effects of the present invention are not hindered.

Further, the image-receiving layer in the present invention may contain a reactive compound such as polyvalent isocyanate compound, epoxy compound or organometallic compound. In this case, the quality of the image-receiving layer is improved.

In addition, it is possible to incorporate a proper auxiliary into the image-receiving layer aiming at providing it with an improved writeability. As such auxiliary, there can be mentioned, for example, inorganic or organic pigments such as ground calcium bicarbonate, precipitated calcium carbonate, talc, clay, natural or synthetic silicate, titanium oxide, aluminum hydroxide, zinc oxide, urea-formaldehyde resin, etc.; ultraviolet ray absorbing agents; antioxidants; antistatic additives; releasing agents; lubricants, etc. These auxiliaries may be used alone or in combination of two or more kinds of them.

The image-receiving layer in the present invention may be properly formed in the manner similar to the foregoing manner of forming the intermediate layer. For instance, the image-receiving layer is formed on the previously formed intermediate layer by using a coating composition containing the foregoing thermosetting resin or a coating composition containing, in addition to the foregoing thermosetting resin, the foregoing pigment or/and the foregoing auxiliary, applying said coating composition onto the surface of the previously formed intermediate layer in a predetermined amount by the foregoing coating means to thereby form a liquid coat and air-drying said liquid coat.

The amount of the foregoing coating composition to be applied to form the image-receiving layer is properly determined depending upon the use purpose of the resulting image-receiving sheet. However, in general, it is desired to be in the range of 2 to 15 g/m$^2$ on a dry basis.

As the substrate of the image-receiving sheet according to the present invention, a wood free paper, a synthetic paper or a polymer film can be selectively used. Among these, the wood free paper is most preferred since it excels not only in heat resisting property but also other thermal properties. The wood free paper used in the present invention includes papers manufactured under acidic conditions, neutral conditions or alkaline conditions which are comprised chiefly of cellulose pulp and added with a wet strength agent, sizing agent, filler such as inorganic or organic pigment, etc.

The wood free paper also includes those papers manufactured by size-pressing the above papers with oxidized starch or the like and other papers having an improved surface physical property manufactured by providing the above papers with a precoat layer containing a pigment such as clay as the main constituent.

Other than those above mentioned, a No. 1 grade coated paper, a coated paper or a cast coated paper can be more suitably used as the substrate in the present invention.

In the present invention, such a thin heat-resistant protective layer containing a silicone resin as the main constituent, capable of permeating a sublimable dye as disclosed in Japanese Unexamined Patent Publication Sho. 59(1984)-165686 or Sho. 61(1986)-27290 may be disposed on the surface of the image-receiving layer. In this case, the dye or the dye layer can be prevented from directly transferring to the image-receiving layer.

As above described, the image-receiving sheet for thermal transfer printing to be provided according to the present invention exhibits marked performances when used in the thermal transfer printing system wherein a dye transfer sheet containing a thermally sublimable dye is used.

The thermally sublimable dye in the present invention includes such dyes that do not cause transfer even on contact with the image-receiving sheet under ordinary handling conditions but cause transfer, for the first time, with application of heat of 60° C. or more by way of melting, vaporation, sublimation and the like.

As such dye, there can be mentioned, for example, disperse system dyes such as azo series dyes, nitro series dyes, anthraquinone series dyes, quinoline series dyes, etc.; basic dyes such as triphenylmethane series dyes, fluoran series dyes, etc.; and oil soluble dyes.

The image-receiving sheet for thermal transfer printing to be provided according to the present invention is usable not only in the thermal transfer printing system wherein contact heat caused, for example, by a heating plate or thermal head of thermal printing unit is utilized but also in other thermal printing system wherein indirect contact heat with the use of infrared lamp, YAG laser or carbon dioxide gas laser is utilized.

PREFERRED EMBODIMENTS OF THE INVENTION

The advantages of the present invention are now described in more detail by reference to the following Examples and Comparative Examples, which are provided here for illustrative purposes only, and are not intended to limit the scope of the present invention.

Unless otherwise indicated, parts and % signify parts by weight and % by weight respectively.

EXAMPLE 1

A coating composition having a solid content of 40% for the intermediate layer was firstly prepared by mixing 570 parts of cross linked styrenic resin fine particles of 0.3 to 0.4 μm in particle size and having a softening point of 156° C. (solid content: 20% (trade name: GRANDOLL PP-5491, produced by Dainippon Ink & Chemicals Inc.), 285 parts of polyolefin resin fine particles (trade name: CHEMIPEARL A-100) and as a binder, 145 parts of styrene-butadiene copolymer emulsion having a solid content of 48% (trade name: L-1690) to obtain a mixture and adding water to the mixture.

The coating composition thus obtained was applied onto a wood-free paper of 128 g/m$^2$ (trade name: SAKINFUJI, produced by Kanzaki Paper Manufacturing Co., Ltd.) in an amount to be 15 g/m$^2$ when dried to form a liquid coat comprising said coating composition on said paper by the use of a wire-bar coater, followed by air-drying, to thereby form an intermediate layer.

Then, a coating composition for the image-receiving layer which was prepared by dissolving 20 parts of polyester resin (trade name: VYLON-200, produced by Toyobo Co., Ltd.) in an solvent composed of 40 parts of methyl ethyl ketone, 40 parts of toluene and 20 parts of cyclohexanone to obtain a solution and adding to the solution 0.3 parts of amino denatured silicone oil (trade name: KF-393, produced by Shinetsu Chemical Co., Ltd.) and 0.3 parts of epoxy denatured silicone oil (trade name: X-33-343, produced by Shinetsu Chemical Co., Ltd.) was applied onto the surface of the previously formed intermediate layer in an amount to be 4 g/m$^2$ when dried in the same manner as in the case of forming the intermediate layer to form a liquid coat. The liquid coat thus formed was then subjected to air-drying and curing at 120° C. for 5 minutes.

The resultant was graduated at a linear pressure of 200 kg/cm by means of a super calender comprising a metal roll having a mirror ground surface and a elastic roll. Thus, there was obtained an image-receiving sheet for thermal transfer printing of the present invention.

COMPARATIVE EXAMPLE 1

A comparative image-receiving sheet for thermal transfer printing was prepared by repeating the procedures of Example 1, except that as the coating composition for the intermediate layer, a coating composition composed of 890 parts of polyolefin resin fine particles (trade name: CHEMIPEARL A-100) and 110 parts of styrene-butadiene copolymer emulsion (trade name: JSR-0530) was used.

COMPARATIVE EXAMPLE 2

A comparative image-receiving sheet for thermal transfer printing was prepared by repeating the procedures of Example 1, except that as the coating composition for the intermediate layer, a coating composition having a solid content of 40% prepared by mixing 865 parts of thermosetting benzoguanamine resin fine particles (trade name: EPOSTAR EPS-MS) and 135 parts of styrene-butadiene copolymer emulsion (trade name: L-1690) to obtain a mixture and adding water to he mixture was used.

COMPARATIVE EXAMPLE 3

A comparative image-receiving sheet for thermal transfer printing was prepared by repeating the procedures of Example 1, except that as the coating composition for the intermediate layer, a coating composition having a solid content of 40% prepared by mixing 250 parts of anatase type titaium oxide fine particles (trade name: FA-55W, produced by Furukawa Mining Co., Ltd.), 600 parts of polyolefin resin fine particles (trade name: CHEMIPEARL A-100) and 150 parts of styrene-butadiene copolymer emulsion (trade name: L-1690) to obtain a mixture and adding water to the mixture was used.

COMPARATIVE EXAMPLE 4

A comparative image-receiving sheet for thermal transfer printing was prepared by repeating the procedures of Example 1, except that as the coating composition for the intermediate layer, a coating composition having a solid content of 40% prepared by mixing 445 parts of polyethylene resin fine particles of 3 μm in particle size and having a softening point of 132° C. (solid content: 40%) (trade name: CHEMIPEARL W-300, produced by Mitsui Petrochemical Industries Co., Ltd.), 445 parts of polyolefin resin fine particles (trade name: CHEMIPEARL A-100) and 110 parts of styrene-butadiene copolymer emulsion (trade name: JSR-0530) to obtain a mixture and adding water to the mixture was used.

EVALUATION

The five image-receiving sheets obtained in Example 1 and Comparative Examples 1 to 4 were evaluated.

In the evaluation of each of the image-receiving sheets, there was used a thermal dye-transfer sheet which was prepared in the way as below described.

That is, 0.45 parts of a blue thermally sublimable disperse dye (trade name: KST-B-714, produced by Nippon Kayaku Co., Ltd.) and 0.4 parts of polyvinyl butyral resin (trade name: Eslec BX-1, produced by Sekisui Chemical Co., Ltd.) were dissolved in a solvent composed of 4.6 parts of methyl ethyl ketone and 4.6 parts of toluene to obtain an ink composition for the formation of a thermal dye-transfer layer. The composition thus obtained was applied onto a 6 μm thick polyethylene terephthalate film whose reverse side has been subjected to heat-resisting treatment, in an amount to be 1.0 g/m$^2$ when dried by means of a wire bar coater and dried to obtain a thermal dye-transfer sheet.

The thermal dye-transfer sheet thus obtained was superposed on the image-receiving sheet sample to be evaluated, followed by printing with application of heat through a thermal head, where a voltage was impressed under conditions of 12 V and 2 to 8 m sec for evaluating the recording sensitivity of the image-receiving sheet sample and the quality of an image as printed.

In addition, the opacity and brightness were evaluated for each of the image-receiving sheet samples.

The above evaluations were made in the following manners.

EVALUATION OF THE RECORDING SENSITIVITY

The image obtained was measured by Macbeth Reflection Densitometer (product of Macbeth Corp., U.S.A.) with its optical density. The results obtained were evaluated with reference to the previously provided standard curve of the recording sensitivity.

EVALUATION OF THE QUALITY OF AN IMAGE OBTAINED

This evaluation was conducted by observing the image obtained by eyes with the use of a magnifier with a 25 times magnification.

EVALUATION OF THE OPACITY

The image-receiving sheet sample was measured in accordance with the manner of JIS-P-8138 to obtain a value. And its opacity was evaluated based on the resultant value.

EVALUATION OF THE BRIGHTNESS

The image-receiving sheet sample was set to Elrepho whiteness Measuring Device (product of Karl Zweis Co., Ltd.) to thereby evaluate its brightness.

The evaluated results were collectively shown in Table 1.

From the results shown in Table 1, it has been recognized that the image-receiving sheet obtained in Example 1 is good or excellent with respect to any of the evaluation items and provides satisfactory results in practical use.

TABLE 1

| | image quality | recording sensitivity | opacity | brightness | total evaluation |
|---|---|---|---|---|---|
| Example 1 | ◎ | ○ | ◎ | ◎ | ◎ |
| Comparative Example 1 | ○ | Δ | X | X | X |
| Comparative Example 2 | X | X | ○ | ○ | X |
| Comparative Example 3 | Δ | X | ○ | ◎ | Δ |
| Comparative Example 4 | ○ | Δ | Δ | X | Δ |

Note:
◎: excellent
○: good
Δ: seems acceptable
X: not acceptable

EXAMPLE 2

There was prepared a mixture composed of: cross-linked styrenic resin fine particles of 0.5 μm in mean particle size (softening point: 156° C., solid content: 45%) (trade name: GRANDOLL pp-2000, produced by Dainippon Ink & Chemicals, Inc.)—450 parts, polyolefin resin fine particles of 5 μm in mean particle size (softening point: 54° C., solid content: 40%) (trade name: CHEMIPEARL A-100, produced by Mitsui Petrochemical Industries Co., Ltd.)—450 parts, and styrene-butadiene copolymer emulsion (solid content: 48%) (trade name: L-1690, produced by Asahi Chemical Industry Co., Ltd.) as a binder—100 parts.

The mixture was added with water to obtain a coating composition having a solid content of 40% for the formation of an intermediate layer.

The coating composition thus obtained was applied onto a wood-free paper of 64 g/m$^2$ (product by Kanzaki Paper Manufacturing Co., Ltd.) in an amount to be 15 g/m$^2$ when dried to form a liquid coat comprising said coating composition on said paper by the use of a wire-bar coater, followed by air-drying, to thereby form an intermediate layer.

Then, a coating composition for the formation of an image-receiving layer which was prepared by a dissolving 20 parts of polyester resin (trade name: VYLON-200, produced by Toyobo Co., Ltd.) in an solvent composed of 40 parts of methyl ethyl ketone, 40 parts of toluene and 20 parts of cyclohexanone to obtain a solution and adding to the solution 0.3 parts of amino denatured silicone oil (trade name: KF-393, produced by Shinetsu Chemical Co., Ltd.) and 0.3 parts of epoxy denatured silicone oil (trade name: X-33-343, produced by Shinetsu Chemical Co., Ltd.) was applied onto the surface of the previously formed intermediate layer in an amount to be 4 g/m$^2$ when dried in the same manner as in the case of forming the intermediate layer to form a liquid coat. The liquid coat thus formed was then subjected to air-drying and curing at 120° C. for 5 minutes.

The resultant was graduated at a linear pressure of 200 kg/cm by means of a super calender comprising a metal roll having a mirror ground surface and a elastic roll. Thus, there was obtained an image-receiving sheet for thermal transfer printing of the present invention.

EXAMPLE 3

The procedures of Example 2 were repeated, except that as the coating composition for the intermediate layer, a coating composition having a solid content of 40% prepared by mixing 450 parts of cross-linked styrenic resin fine particles of 0.6 μm in mean particle size (softening point: 156° C., solid content: 40%) (trade name: GRANDOLL pp-5490, produced by Dainippon Ink & Chemicals, Inc.), 450 parts of polyolefin resin fine particles of 5 μm in mean particle size (softening point: 54° C., solid content: 40%) (trade name: CHEMIPEARL A-100, produced by Mitsui Petrochemical Industries Co., Ltd.) and 100 parts of styrene-butadiene copolymer emulsion (trade name: L-1690, produced by Asahi Chemical Industry Co., Ltd.) as a binder to obtain a mixture and adding water to the mixture was used, to thereby obtain an image-receiving sheet for thermal transfer printing of the present invention.

EXAMPLE 4

The procedures of Example 2 were repeated, except that as the coating composition for the intermediate layer, a coating composition having a solid content of 30% prepared by mixing 450 parts of cross-linked styrenic resin fine particles of 0.7 μm in mean particle size (softening point: 156° C., solid content: 20%) (trade name: GRANDOLL pp-5513, produced by Dainippon Ink & Chemicals, Inc.), 450 parts of polyolefin resin fine particles of 5 μm in mean particle size (softening point: 54° C., solid content: 40%) (trade name: CHEMIPEARL A-100, produced by Mitsui Petrochemical Industries Co., Ltd.) and 100 parts of styrene-butadiene copolymer emulsion (trade name: L-1690, produced by Asahi Chemical Industry Co., Ltd.) as a binder to obtain a mixture and adding water to the mixture was used, to thereby obtain an image-receiving sheet for thermal transfer printing of the present invention.

EXAMPLE 5

There was prepared a mixture composed of: acryl-styrenic resin fine particles of 0.5 μm in mean particle size (softening point: 135° C., solid content: 50%) (trade name: LYTRON 2503, produced by Morton Thiokol Inc.)—450 parts, polyolefin resin fine particles of 3 μm in mean particle size (softening point: 132° C., solid content: 40%) (trade name: CHEMIPEARL W-300, produced by Mitsui Petrochemical Industries Co., Ltd.)—450 parts, and styrene-butadiene copolymer emulsion (solid content: 48%) (trade name: L-1690, produced by Asahi Chemical Industry Co., Ltd.) as a binder—100 parts.

The mixture was added with water to obtain a coating composition having a solid content of 40% for the formation of an intermediate layer.

The coating composition thus obtained was applied onto a wood-free paper of 64 g/m$^2$ (product of Kanzaki Paper Manufacturing Co., Ltd.) in an amount to be 15 g/m$^2$ when dried to form a liquid coat comprising said coating composition on said paper by the use of a wire-bar coater, followed by air-drying, to thereby form an intermediate layer.

Then, a coating composition having a nonvolatile content of 25% for the formation of an image-receiving layer which was prepared by 90 parts of polyester resin dispersion of 30% in solid content (trade name: FINETEX ES-650, produced by Dainippon Ink & Chemicals, Inc.), 2 parts of water-soluble denatured silicon oil (trade name: TORAY Silicon SH-3771, produced by Toray Silicon Co., Ltd.), 2 parts of oily epoxy cross linking catalyst (trade name: CR-5L, produced by Dainippon Ink & chemicals, Inc.), 5 parts of colloidal silica water dispersion having a nonvolatile content of 30% (trade name: ADELITE AT-30A, produced by Asahidenka Kogyo Kabushiki Kaisha) and 1 part of epoxy cross linking catalizer (trade name: CATALYST PA-20, produced by Dainippon Ink & Chemicals, Inc.) to obtain a mixture and adding water to the mixture was applied onto the surface of the previously formed intermediate layer in an amount to be 5 g/m$^2$ when dried in the same manner as in the case of forming the intermediate layer to form a liquid coat. The liquid coat thus formed was then subjected to air-drying and curing at 100° C. for 30 seconds in an oven dryer.

The resultant was graduated at a linear pressure of 200 kg/cm by means of a super calender comprising a metal roll having a mirror ground surface and a elastic roll. Thus, there was obtained an image-receiving sheet for thermal transfer printing of the present invention.

EXAMPLE 6

The procedures of Example 5 were repeated, except that as the coating composition for the intermediate layer, a coating composition having a solid content of 40% prepared by mixing 450 parts of acryl-styrenic resin fine particles of 0.17 μm in mean particle size (softening point: 135° C., solid content: 50%) (trade name: LYTRON 614, produced by Morton Thiokol Inc.), 450 parts of polyolefin resin fine particles of 3 μm in mean particle size (softening point: 54° C., solid content: 40%) (trade name: CHEMIPEARL W-300, produced by Mitsui Petrochemical Industries Co., Ltd.) and 100 parts of styrene-butadiene copolymer emulsion (trade name: L-1690, produced by Asahi Chemical Industry Co., Ltd.) as a binder to obtain a mixture and adding water to the mixture was used, to thereby obtain an image-receiving sheet for thermal transfer printing of the present invention.

EXAMPLE 7

The procedures of Example 5 were repeated, except that as the coating composition for the intermediate layer, a coating composition having a solid content of 40% prepared by mixing 450 parts of acryl-styrene copolymer resin fine particles of 0.55 μm in mean particle size (softening point: higher than 120° C., solid content: 42%) (trade name: RHOPAQUE OP-84J, produced by Rhom & Haas Japan Kabushiki Kaisha), 450 parts of polyolefin resin fine particles of 5 μm in mean particle size (softening point: 54° C., solid content: 40%) (trade name: CHEMIPEARL A-100, produced by Mitsui Petrochemical Industries Co., Ltd.) and 100 parts of styrene-butadiene copolymer emulsion (solid content: 50% (trade name: JSR-0530, produced by Japan Synthetic Rubber Co., Ltd.) as a binder to obtain a mixture and adding water to the mixture was used, to thereby obtain an image-receiving sheet for thermal transfer printing of the present invention.

EXAMPLE 8

The procedures of Example 5 were repeated, except that as the coating composition for the intermediate layer, a coating composition having a solid content of 40% prepared by mixing 450 parts of highly cross-linked acryl-styrenic resin fine particles of 1 μm in mean particle size (softening point: higher than 120° C., solid content: 50%) (trade name: XMRP-110, produced by Mitsui Petrochemical Industries Co., Ltd.), 450 parts of polyolefin resin fine particles of 5 μm in mean particle size (softening point: 54° C., solid content: 40%) (trade name: CHEMIPEARL A-100, produced by Mitsui Petrochemical Industries Co., Ltd.) and 100 parts of styrene-butadiene copolymer emulsion (trade name: L-1690, produced by Asahi Chemical Industry Co., Ltd.) as a binder to obtain a mixture and adding water to the mixture was used, to thereby obtain an image-receiving sheet for thermal transfer printing of the present invention.

EXAMPLE 9

The procedures of Example 5 were repeated, except that as the coating composition for the intermediate layer, a coating composition having a solid content of 40% prepared by mixing 450 parts of highly cross-linked acryl-styrenic resin fine particles of 0.5 μm in mean particle size (softening point: higher than 120°°C., solid content: 50%) (trade name: XMRP-140, produced by Mitsui Petrochemical Industries, Co., Ltd.), 450 parts of polyolefin resin fine particles of 5 μm in mean particle size (softening point: 54° C., solid content: 40%) (trade name: CHEMIPEARL A-100, produced by Mitsui Petrochemical Industries Co., Ltd.) and 100 parts of styrene-butadiene copolymer emulsion (trade name: L-1690, produced by Asahi Chemical Industry Co., Ltd.) as a binder to obtain a mixture and adding water to the mixture was used, to thereby obtain an image-receiving sheet for thermal transfer printing of the present invention.

COMPARATIVE EXAMPLE 5

The procedures of Example 2 were repeated, except that as the coating composition for the intermediate layer, a coating composition prepared by mixing 900 parts of polyolefin resin fine particles of 5 μm in mean particle size (softening point: 54° C., solid content: 40%) (trade name: CHEMIPEARL A-100, produced by Mitsui Petrochemical Industries Co., Ltd.) and 100 parts of styrene-butadiene copolymer emulsion (solid content: 50%) (trade name: JSR-0530, Japan Synthetic Rubber Co., Ltd.) was used, to thereby obtain a comparative image-receiving sheet for thermal transfer printing.

COMPARATIVE EXAMPLE 6

The procedures of Example 2 were repeated, except that as the coating composition for the intermediate layer, a coating composition prepared by mixing 450 parts of thermosetting benzoguanamine resin fine particles of 2 μm in mean particle size (trade name: EPOSTER EPS-MS, produced by Nippon Shokubai Kagaku Kogyo Co., Ltd.), 450 parts of polyolefin resin fine particles of 5 μm in mean particle size (softening point: 54° C., solid content: 40%) (trade name: CHEMIPEARL A-100, produced by Mitsui Petrochemical Industries Co., Ltd.) and 100 parts of styrene-butadiene copolymer emulsion (trade name: L-1690, produced by Asahi Chemical Industry Co., Ltd.) as a binder was used, to thereby obtain a comparative image-receiving sheet for thermal transfer printing.

COMPARATIVE EXAMPLE 7

The procedures of Example 5 were repeated, except that as the coating composition for the intermediate layer, a coating composition having a solid content of 30% prepared by mixing 450 parts of cross-linked styrenic resin particles of 2.7 in mean particle size (softening point: 156° C., solid content: 20%) (trade name: GRANDOLL pp-5516, produced by Dainippon Ink & Chemicals Inc.), 450 parts of polyolefin resin fine particles of 5 μm in mean particle size (softening point: 54° C., solid content: 40%) (trade name: CHEMIPEARL A-100, produced by Mitsui Petrochemical Industries, Co., Ltd.) and 100 parts of styrene-butadiene copolymer emulsion (trade name: L-1690, produced by Asahi Chemical Industry Co., Ltd.) as a binder to obtain a mixture and adding water to the mixture, to thereby obtain a comparative image-receiving sheet for thermal transfer printing.

COMPARATIVE EXAMPLE 8

The procedures of Example 5 were repeated, except that as the coating composition for the intermediate layer, a coating composition prepared by mixing 900 parts of polyolefin resin fine particles of 1 μm in mean particle size (solid content: 40%) (trade name: CHEMIPEARL WX-88, produced by Mitsui Petrochemical Industries Co., Ltd.) and 100 parts of Styrene-butadiene copolymer emulsion (solid content: 50%) (trade name: JSR-0530, produced by Japan Synthetic Rubber Co., Ltd.) was used, to thereby obtain a comparative image-receiving sheet for thermal transfer printing.

COMPARATIVE EXAMPLE 9

The procedures of Example 2 were repeated, except that as the coating composition for the intermediate layer, a coating composition having a solid content of 40% prepared by mixing 450 parts of polyethylene resin fine particles of 3 μm in mean particles size (softening point: 132° C.) (trade name: CHEMIPEARL W-300, produced by Mitsui Petrochemical Industries Co., Ltd.), 450 parts of polyolefin resin fine particles of 5 μm in mean particle size (softening point: 54° C., solid content: 40%) (trade name: CHEMIPEARL A-100, produced by Mitsui Petrochemical Industries Co., Ltd.) and 100 parts of styrene-butadiene copolymer emulsion (solid content: 50%) (trade name: JSR-0530, produced by Japan Synthetic Rubber Co., Ltd.) as a binder to obtain a mixture and adding water to the mixture was used, to thereby obtain a comparative image-receiving sheet for thermal transfer printing.

COMPARATIVE EXAMPLE 10

The procedures of Example 2 were repeated, except that as the coating composition for the intermediate layer, a coating composition having a solid content of 40% prepared by mixing 450 parts of anatase type titanium oxide fine particles (trade name: FA-55W, produced by Furukawa Co., Ltd.), 450 parts of polyolefin resin fine particles of 5 μm in mean particle size (softening point: 54° C., solid content: 40%) (trade name: CHEMIPEARL A-100, produced by Mitsui Petrochemical Industries Co., Ltd.) and 100 parts of styrene-butadiene copolymer emulsion (trade name: L-1690, produced by Asahi Chemical Industry Co., Ltd.) as a binder to obtain a mixture and adding water to the mixture was used, to thereby obtain a comparative image-receiving sheet for thermal transfer printing.

COMPARATIVE EXAMPLE 11

The procedures of Example 2 were repeated, except that as the coating composition for the intermediate layer, a coating composition having a solid content of 40% prepared by mixing 900 parts of acryl-styrene copolymer fine particles of 0.55 μm in mean particle size (softening point: higher than 120° C., solid content: 42%) (trade name: ROHPAQUE OP-84J, produced by Rhom & Haas Japan Kabushiki Kaisha) and 100 parts of styrene-butadiene copolymer emulsion (solid content: 50%) (trade name: JSR-0530, produced by Japan Synthetic Rubber Co., Ltd.) as a binder to obtain a mixture and adding water to the mixture was used, to thereby obtain a comparative image-receiving sheet for thermal transfer printing.

EVALUATION

The fifteen image-receiving sheets obtained in Examples 2 to 9 and Comparative Examples 5 to 11 were evaluated with respect to the recording sensitivity, the quality of an image printed, the opacity of the sheet, the brightness of the sheet, the surface smoothness of the sheet and the gloss of the sheet.

The evaluated results for each of the resultant sheets with respect to each of said evaluation items were shown in Table 2.

In the evaluation of each of the image-receiving sheets, there was used a thermal dye-transfer sheet which was prepared in the way as below described.

That is, 0.45 parts of a blue thermally sublimable disperse dye (trade name: KST-B-714, produced by Nippon Kayaku Co., Ltd.) and 0.4 parts of polyvinyl butyral resin (trade name: Eslec BX-1, produced by Sekisui Chemical Co., Ltd.) were dissolved in a solvent composed of 4.6 parts of methyl ethyl ketone and 4.6 parts of toluene to obtain an ink composition for the formation of a thermal dye-transfer layer. The composition thus obtained was appliied onto a 6 μm thick polyethylene terephthalate film whose reverse side has been subjected to heat-resisting treatment, in an amount to be 1.0 g/m$^2$ when dried by means of a wire bar coater and dried to obtain a thermal dye-transfer sheet.

The thermal dye-transfer sheet thus obtained was superposed on the image-receiving sheet sample to be evaluated, followed by printing with application of heat through a thermal head, where a voltage was impressed under conditions of 12 V and 2 to 8 ms for evaluating the recording sensitivity of the image-receiving sheet sample and the quality of an image as printed.

The opacity, brightness, surface smoothness and gloss were evaluated in the following manners.

EVALUATION OF THE RECORDING SENSITIVITY

The image obtained was measured by Macbeth Reflection Densitometer (product of Macbeth Corp., U.S.A.) with its optical density. The results obtained were evaluated with reference to the previously provided standard curve of the recording sensitivity.

EVALUATION OF THE QUALITY OF AN IMAGE OBTAINED

This evaluation was conducted by observing the image obtained by eyes with the use of a magnifier with a 25 times magnification.

EVALUATION OF THE OPACITY

The image-receiving sheet sample was measured in accordance with the manner of JIS-P-8138 to obtain a value. And its opacity was evaluated based on the resultant value.

EVALUATION OF THE BRIGHTNESS

The image-receiving sheet sample was set to Elrepho Whiteness Measuring Device (product of Karl Zeiss Co., Ltd.) to thereby evaluate its brightness.

EVALUATION OF THE SURFACE SMOOTHNESS

The image-receiving sheet sample was measured in accordance with the manner of JIS-P-8119 to obtain a value. And its surface smoothness was evaluated based on the resultant value.

EVALUATION OF THE GLOSS

The image-receiving sheet sample was measured in accordance with the manner 3 of JIS-Z-8741 wherein the angle of incident light was made 45° C. to obtain a value. And its gloss was evaluated based on the resultant value.

The evaluated results were collectively shown in Table 2.

From the results shown in Table 2, it has been recognized that any of the image-receiving sheets obtained in Examples 2 to 9 is good or excellent with respect to any of the evaluation items and provides satisfactory results in practical use.

TABLE 2

| | image quality | recording sensitivity | brightness | opacity | surface smoothness | gloss | Total evaluation |
|---|---|---|---|---|---|---|---|
| Example 2 | ○ | ○ | 88.7 | 86.2 | 673 | 37.1 | ○ |
| Example 3 | ◎ | ○ | 87.2 | 85.3 | 689 | 40.2 | ◎ |
| Example 4 | ◎ | ○ | 88.3 | 85.9 | 660 | 40.2 | ◎ |
| Example 5 | ○ | ○ | 85.4 | 83.6 | 644 | 47.2 | ○ |

TABLE 2-continued

| | image quality | recording sensitivity | brightness | opacity | surface smoothness | gloss | Total evaluation |
|---|---|---|---|---|---|---|---|
| Example 6 | ◎ | ○ | 84.2 | 81.2 | 1119 | 34.8 | ◎ |
| Example 7 | ◎ | ◎ | 85.6 | 85.2 | 655 | 55.5 | ◎ |
| Example 8 | ○ | ○ | 85.1 | 82.9 | 688 | 45.0 | ○ |
| Example 9 | ○ | Δ | 85.5 | 84.5 | 756 | 49.0 | ○ |
| Comparative Example 5 | ○ | ○ | 84.1 | 81.1 | 562 | 33.2 | Δ |
| Comparative Example 6 | Δ | ○ | 84.9 | 79.8 | 445 | 13.5 | X |
| Comparative Example 7 | Δ | ○ | 86.2 | 80.0 | 426 | 25.4 | Δ |
| Comparative Example 8 | Δ | ○ | 84.6 | 80.9 | 808 | 39.0 | X |
| Comparative Example 9 | ○ | ○ | 84.5 | 79.9 | 750 | 36.2 | Δ |
| Comparative Example 10 | X | Δ | 87.6 | 90.1 | 523 | 24.8 | X |
| Comparative Example 11 | Δ | ○ | 88.1 | 88.8 | 455 | 49.8 | Δ |

Note:
◎: excellent
○: good
Δ: seems acceptable
X: not acceptable

What we claim is:

1. An image-receiving sheet for thermal transfer printing comprising a substrate, an intermediate layer disposed on said substrate, and an image-receiving layer disposed on said intermediate layer, wherein said intermediate layer comprises a layer containing (a) fine particles of a polyolefin resin whose mean particle size is in the range of 1 to 20 μm and (b) fine particles of a thermosetting resin whose mean particle size is one fifth or less of said mean particle size of said fine particles (a), as the main constituents.

2. An image-receiving sheet for thermal transfer printing comprising a substrate, an intermediate layer disposed on said substrate, and an image-receiving layer disposed on said intermediate layer, wherein said intermediate layer comprises a layer containing (a) fine particles of a polyolefin resin whose mean particle size is in the range of 1 to 20 μm and (b) fine particles of a thermoplastic resin other than a polyolefin resin whose mean particle size is one fifth or less of said mean particle size of said fine particles (a) and which has a softening point of higher than 120° C., as the main constituents.

3. An image-receiving sheet for thermal transfer printing comprising a substrate, an intermediate layer disposed on said substrate, and an image-receiving layer disposed on said intermediate layer, wherein said intermediate layer comprises a layer containing (a) fine particles of a polyolefin resin whose mean particle size is in the range of 1 to 20 μm, (b) fine particles of a thermosetting resin whose mean particle size is one fifth or less of said mean particle size of said fine particles (a), and (c) fine particles of a thermoplastic resin other than a polyolefin resin whose means particle size is one fifth or less of said mean particle size of said fine particles (a) and which has a softening point of higher than 120° C., as the main constituents.

* * * * *